United States Patent [19]

Ikegaki et al.

[11] Patent Number: 4,560,900

[45] Date of Patent: Dec. 24, 1985

[54] CATHODE RAY TUBE DEVICE WITH ELECTROMAGNETIC SHIELD CASING

[75] Inventors: Makoto Ikegaki, Fukaya; Masayuki Nakanishi, Isezaki; Humiyuki Sato; Tokuo Hashimoto, both of Fukaya, all of Japan

[73] Assignee: Tokyo Shibaura Denki Kabushiki Kaisha, Kawasaki, Japan

[21] Appl. No.: 404,496

[22] Filed: Aug. 2, 1982

[30] Foreign Application Priority Data

Aug. 4, 1981 [JP] Japan ..... 56-115323[U]
Sep. 1, 1981 [JP] Japan ..... 56-128725[U]

[51] Int. Cl.[4] ..... H01J 29/86

[52] U.S. Cl. ..... 313/479; 315/85; 313/312; 313/482

[58] Field of Search ..... 313/479, 482, 477 R, 313/312; 358/245, 248; 220/2.1 A; 315/85, 8

[56] References Cited

U.S. PATENT DOCUMENTS 2,114,612 4/1938 Schlesinger ..... 313/312 X
2,440,260 4/1948 Gall ..... 313/482 X
2,456,399 12/1948 Gethmann ..... 313/312 X
2,721,995 10/1955 Friend ..... 315/8 X
3,404,227 10/1968 Alcala .
3,422,220 1/1969 Bathelt et al. ..... 358/245

FOREIGN PATENT DOCUMENTS 2447657 8/1980 France .
425493 3/1925 United Kingdom .
2054950 2/1981 United Kingdom .

OTHER PUBLICATIONS

IBM Technical Disclosure Bulletin, vol. 14, No. 1, Jun. 1971, L. E. Swenson, "CRT Mounting System", p. 146.

*Primary Examiner*—Palmer C. DeMeo
*Attorney, Agent, or Firm*—Cushman, Darby & Cushman

[57] ABSTRACT

A cathode ray tube device which comprises an electromagnetic shielding casing, a cathode ray tube held in said casing, an elastic material provided between the casing and cathode ray tube in contact therewith, and a space or porous material formed in part of a region defined between the casing and elastic material, and wherein said space or porous material suppresses the axial shifting of the cathode ray tube resulting from the thermal expansion of the elastic material when it is highly heated.

7 Claims, 7 Drawing Figures

CATHODE RAY TUBE DEVICE WITH ELECTROMAGNETIC SHIELD CASING

BACKGROUND OF THE INVENTION

This invention relates to a cathode ray tube device which comprises a cathode ray tube held in an electromagnetic shielding casing by means of an elastic body.

Hitherto, a cathode ray tube has been widely used with a control device of mechanical or other apparatuses as means for transmitting instructions or information. Some of these mechanical or other apparatuses are sometimes applied in a very rigid environment or demanded to have a high reliability. For instance, a cathode ray tube may be cited which is used with a control system of airplanes or automobiles. With a cathode ray tube device used for such object, a cathode ray tube is held by an elastic body prepared from, for example, silicone resin in an electromagnetic shielding casing. The purpose is to let the cathode ray tube device withstand changes in a magnetic field resulting from variations in a magnetic field prevailing in a near-by implement or geomagnetism or resist mechanical vibrations. FIG. 1 schematically illustrates this arrangement. A cathode ray tube 1 is held in an electromagnetic shielding case 2 (hereinafter referred to as "a case") by an elastic body 3. This arrangement enables the cathode ray tube 1 to be shielded by the case 2 from variations in an external magnetic field prevailing in the environment in which said cathode ray tube 1 is applied, and also protected from mechanical vibrations by means of said elastic body 3. However, the conventional cathode ray tube device of FIG. 1 has the drawbacks that when the environment in which said cathode ray tube device is applied is considerably heated, then the elastic body 3 is thermally expanded, causing a thermal stress to be applied to the funnel section of the cathode ray tube in a direction indicated by arrows A and eventually causing the cathode raytube 1 to be axially pushed out of the case 2 in a direction indicated by an arrow B. To reduce the extent to which the cathode ray tube 1 is pushed, it may be advised to reduce the degree in which the funnel section of the cathode ray tube 1 is inclined to the axial direction thereof. However, the extent to which the funnel section of the cathode ray tube 1 can be inclined is extremely limited from the standpoint of manufacturing a glass bulb. In start, an attempt to carry out the above-mentioned modifications is practically impossible.

SUMMARY OF THE INVENTION

It is the object of this invention to provide a cathode ray tube device which allows for the suppression of any undesirable axial shifting of a cathode ray tube.

According to one aspect of the invention, there is provided a cathode ray tube device which comprises:

- an electromagnetic shielding casing;
- a cathode ray tube held in said casing;
- an elastic material provided between said casing and cathode ray tube in contact therewith; and
- a space formed in part of a region defined between the electromagnetic shielding casing and elastic material.

According to another aspect of the invention, there is provided a cathode ray tube device which comprises:

- an electromagnetic shielding casing;
- a cathode ray tube held in said casing;
- an elastic material provided between said casing and cathode ray tube in contact therewith; and
- a porous material formed in part of a region defined between the casing and elastic material.

DETAILED DESCRIPTION OF THE PREFERRED EMBODIMENTS

Figure 1:
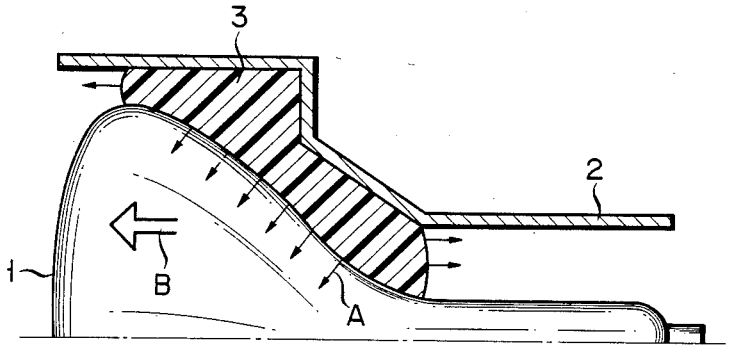
FIG. 1 (PRIOR ART)
FIG. 1 is a fractional sectional view of the conventional cathode ray tube device.
Figure 2:
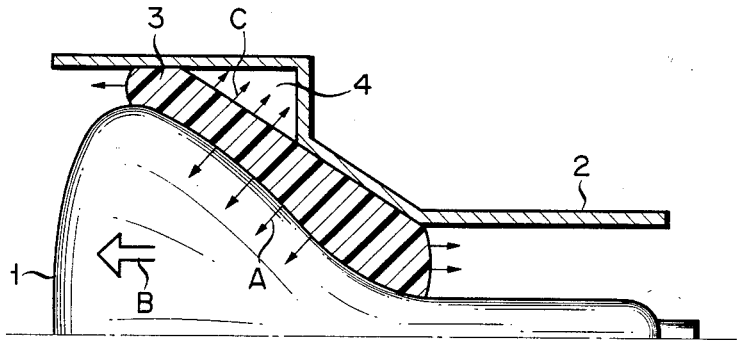
FIG. 2 is a fractional sectional view of a cathode ray tube device according to one embodiment of this invention.

FIG. 2 is a sectional view of a cathode ray tube device according to one embodiment of this invention. The parts of FIG. 2 the same as those of FIG. 1 are denoted by the same numerals, description thereof being omitted. A space 4 is formed in part of a region defined between the elastic body 3 and case 2. When the environment in which the cathode ray tube device embodying this invention is applied is considerably heated, the thermal expansion of said cathode ray tube partly proceeds in a direction indicated by arrows C to fill the space 4, thereby prominently reducing the extent to which the cathode ray tube 1 is pushed out of the case 2 in a direction indicated by an arrow B.

Description is now given of the method of providing said space 4.

Figure 3:
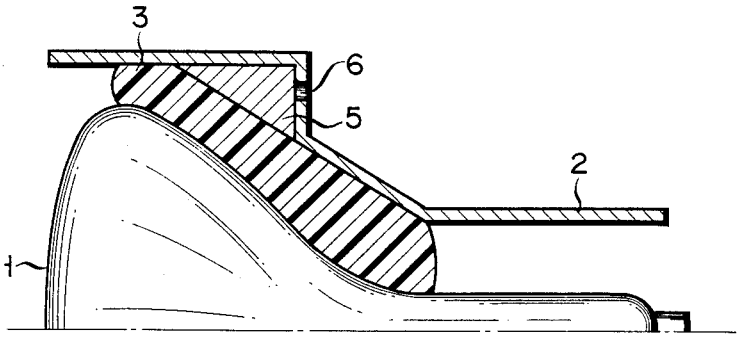
FIGS. 3 and 4 are sectional views illustrating the method of forming a space in part of a region defined between the electromagnetic shielding casing and elastic body.

As seen from FIG. 3, a low melting material 5 such as paraffin is filled in the prescribed section of the interior of the case 2 where a space is to be provided. The case 2 is drilled with a penetrating hole 6 through which the paraffin 5 can later be drawn off. The cathode ray tube 1 is let to occupy a prescribed position in the case 2 now filled with the paraffin. An elastic material, such as silicone resin is poured into the remaining portion of the aforementioned space. After the silicon resin elastic body is fully hardened, the paraffin is thermally fused to be drawn off through the hole 6. As a result, a space 4 is provided in a space defined between the case and the elastic body which was previously filled with the paraffin 5.

Figure 4:
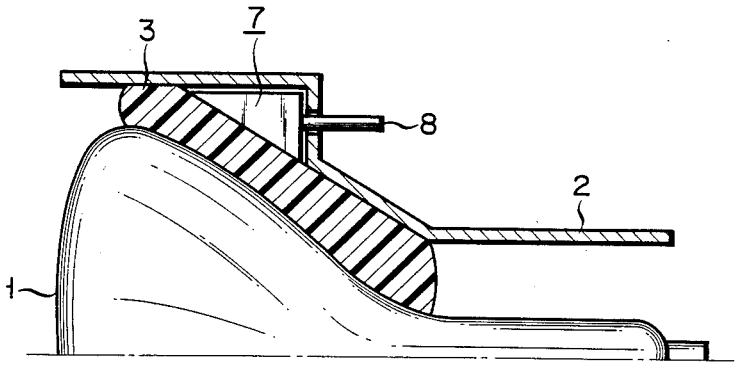
Figure 5:
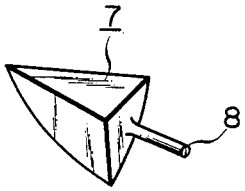
FIG. 5 is an oblique view of a spacer used with the cathode ray tube device of FIG. 4.

FIGS. 4 and 5 show another method of providing a space. A spacer 7 is previously prepared from a hollow rubbery elastic material in such a shape as matches the prescribed space. The spacer 7 is provided at one end with an air inlet projection 8. The spacer 7 is set, as shown in FIG. 4, in the prescribed position in the case 2 where the aforementioned space is to be formed. In this case the air inlet projection 8 of the spacer 7 is made to project out of the case 2 through the penetrating hole 6. Later, a cathode ray tube 1 is set in place in the case 2. An elastic material 3 is poured into a space defined between the case 2 and cathode ray tube 1 to be later naturally hardened. After the elastic material 3 is fully hardened, the air inlet projection 8 of the spacer 7 is cut off at a proper spot outside of the case 2. Either of the above-described methods enables a space to be easily formed in a prescribed section of a space defined between the case 2 and elastic material 3 in a desired shape and sized.

Figure 6:
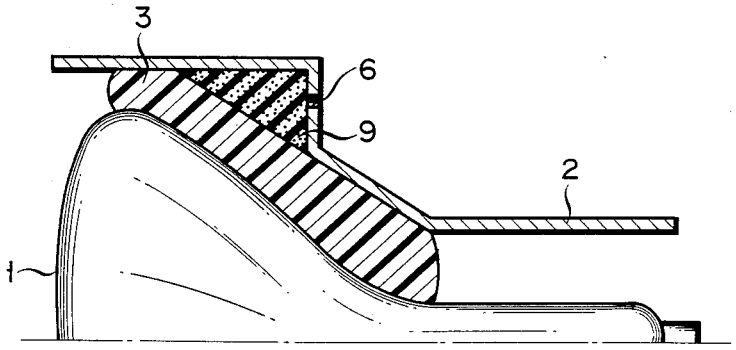
FIG. 6 is a fractional sectional view of a cathode ray tube device according to another embodiment of the invention.

Description is now given with reference to FIG. 6 of a cathode ray tube device according to another embodiment of this invention. The parts of FIG. 6 the same as those of FIG. 2 are denoted by the same numerals, description being omitted. The cathode ray tube 1 is held in the case 2 by an elastic material 3 prepared from, for example, silicone resin. A porous material 9 is provided in part of a space defined between the case 2 and elastic material 3. With the second embodiment of FIG. 6, the porous material 9 consists of a sponge having a density of 0.034 g/cm$^3$ and numerous cells as 40 per inch. That part of the case 2 which faces the porous material 9 is drilled with a fine penetrating hole having a diameter ranging from 0.5 mm to 2 mm. It is possible to provide not only one fine penetrating hole, but also a plurality thereof.

Description is now given of the second embodiment of FIG. 6 in which the cathode ray tube device is particularly provided with the porous material 9. A sponge 9 having a prescribed shape is provided in addition to the cathode ray tube 1 and case 2. The sponge 9 is temporarily fitted to the prescribed section of the case 2 by adhesive. This sponge fully elastically absorbs a mechanical pressure to which it is exposed, and consequently is not demanded to have an appreciably high dimensional precision. The cathode ray tube 1 is set in a prescribed position in the case 2. Thermally fused silicone resin is filled and hardened in a space defined between the cathode ray tube 1 and case 2 to constitute an elastic material 3. In this case, an appreciable amount of the silicone resin 3 is absorbed in the sponge 9 contacting said silicone resin. The remaining portion of the sponge 9 plays an important role. When the cathode ray tube device is heated during operation, a stress applied particularly to the proximity of the funnel section of the cathode ray tube due to the thermal expansion of the elastic material 3 is absorbed in the remainder of the porous sponge 9. Therefore, the axial forward shifting of the cathode ray tube is prominently restricted. Said forward shifting of the cathode ray tube is also affected by the extent to which the elastic material 3 of silicone resin is absorbed in the porous material 9 when said elastic material 3 is filled in the space. The density, cell number and quality of the porous material 9 are selected in accordance with the viscosity of the elastic material 3 before hardening and the final hardness thereof. The lower limit to the density of said porous material 9 should be selected by quantity of the absorption of the elastic material 3 into the porous material 9. The extent of said absorption is defined by the viscosity of the elastic material 3 when filled in the space. When the elastic material 3 is prepared from silicon resin having a viscosity of 100 poises and a hardness of 15, then it is most preferred to use a porous material having a density of 0.03 to 0.07 g/cm$^3$ and 35 to 60 cells per inch.

Figure 7:
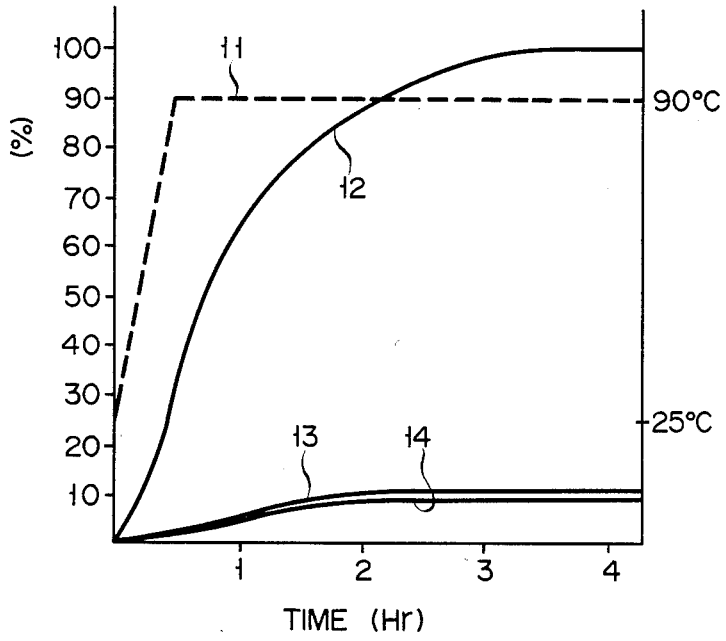
FIG. 7 is a graphic comparative chart showing the extent to which, the cathode ray tube of a cathode ray tube device embodying this invention makes an axial movement, when heated, and the extent of such axial movement observed in the conventional cathode ray tube device.

FIG. 7 is a curve diagram showing the extent to which the elastic material is pushed by the heating of the cathode ray tube 1. A heating time (Hr) is shown on the abscissa, the extent (%) of the forward shifting of the elastic material is indicated on the left ordinate, and the heating temperature (°C.) is set forth on the right ordinate. FIG. 7 indicating a broken line 11 denoting the heating condition distinctly shows that the extent 13 of the forward pushing of the elastic material is more prominently suppressed by the embodiment of FIG. 6 than the extent 12 of the forward pushing of the elastic material realized by the conventional cathode ray tube device. No substantial difference is recognized between the extent 13 of the forward pushing of the elastic material observed in the embodiment of FIG. 6 and the extent 14 of said forward pushing detected in the embodiment of FIG. 2.

With the cathode ray tube device embodying this invenion, a space or porous material is provided, as previously described, in part of a region defined between the elastic material and electromagnetic shielding casing. This arrangement effectively suppresses the axial forward pushing of the cathode ray tube resulting from the thermal expansion of the elastic material when it is highly heated.

Even when, therefore, applied in an environment of high temperature, the cathode ray tube device embodying the invention remains stable, because the position of the cathode ray tube does not shift in the axial direction.

What we claim is:

1. A cathode ray tube device which comprises:
an electromagnetic shielding casing;
a cathode ray tube held in said casing;
an elastic material which is provided between said casing and cathode ray tube in contact therewith; and
a porous material formed in part of a region defined solely between the casing and elastic material.

2. The cathode ray tube device according to claim 1, wherein the casing is provided with a penetrating hole communicating with said porous material.

3. A cathode ray tube device comprising:
an electromagnetic shielding casing;
a cathode ray tube disposed in said casing and defining therewith an annular chamber;
an elastic medium filling a portion of said annular chamber to thereby fix said tube to said casing; wherein
said casing includes means defining an annular space solely between said casing and said elastic medium, said space defining means communicating with said elastic medium to accept a portion of said elastic medium therein when said elastic medium thermally expands for suppressing axial displacement of said tube relative to said casing, and wherein,
said annular space is filled with porous material means for absorbing thermal expansion of said elastic medium.

4. A cathode ray tube as in claim 3 further comprising means defining a hole in communication with said porous material means.

5. A cathode ray tube device comprising:
an electromagnetic shielding casing;
a cathode ray tube disposed in said casing and defining therewith an annular chamber;
an elastic medium filling a portion of said annular chamber to thereby fix said tube to said casing; and
displacement suppressing means operatively associating said casing and said electric medium for suppressing axial forward displacement of said tube in response to thermal expansion of said elastic medium, said displacement suppressing means including an annular space defined solely between a portion of said elastic medium and said casing, wherein said space accepts thermal expansion of said elastic medium therein to suppress forces from acting upon said tube by virtue of said elastic medium thermal expansion, which forces tend to forwardly displace said tube relative to said casing, wherein said displacement suppressing means includes porous material means filling said annular space for absorbing thermal expansion of said elastic medium.

6. A cathode ray tube device as in claim 5 wherein said porous material means comprises a porous material having a density of 0.03 to 0.07 g/cm$^3$ and 35 to 60 cells per inch.

7. A cathode ray tube device as in claim 5 further comprising means defining a hole in communication with said porous material means.

* * * * *